United States Patent [19]

Dupressoir et al.

[11] 4,298,878

[45] Nov. 3, 1981

[54] RADIATING SOURCE FORMED BY A DIPOLE EXCITED BY A WAVEGUIDE AND AN ELECTRONICALLY SCANNING ANTENNA COMPRISING SUCH SOURCES

[75] Inventors: Albert Dupressoir; François Salvat, both of Paris, France

[73] Assignee: Thomson-CSF, Paris, France

[21] Appl. No.: 133,883

[22] Filed: Mar. 25, 1980

[30] Foreign Application Priority Data

Mar. 28, 1979 [FR] France ..... 79 07801

[51] Int. Cl.[3] ..... H01Q 1/38; H01Q 1/36

[52] U.S. Cl. ..... 343/795; 343/815; 343/772; 343/854

[58] Field of Search ..... 343/730, 772, 783, 786, 343/807, 795, 815, 854

[56] References Cited

U.S. PATENT DOCUMENTS 2,880,417 3/1959 Lovick ..... 343/772

3,623,112 11/1971 Rupp ..... 343/727

3,778,839 12/1973 Kovar ..... 343/772

FOREIGN PATENT DOCUMENTS 660553 4/1963 Canada ..... 343/786

1018482 10/1957 Fed. Rep. of Germany ..... 343/772

*Primary Examiner*—Eli Lieberman

*Attorney, Agent, or Firm*—Karl F. Ross

[57] ABSTRACT

Disclosed is a radiating source formed by a dipole excited by a flat waveguide which is rectangular in section and is formed by a dielectric sheet having the shape of a rectangular prism whose major and minor faces are each covered with a metal layer of lesser length. The two major faces parallel to the longitudinal midplane are each extended toward the end of the dielectric sheet by means of a metal tongue terminating in one of the stems of the dipole. These stems may be parallel or perpendicular to the direction of polarization of the electric wave radiated by the guide.

17 Claims, 7 Drawing Figures

RADIATING SOURCE FORMED BY A DIPOLE EXCITED BY A WAVEGUIDE AND AN ELECTRONICALLY SCANNING ANTENNA COMPRISING SUCH SOURCES

FIELD AND BACKGROUND OF THE INVENTION

Our present invention relates to a radiating source formed by a dipole excited by a waveguide of rectangular section which can be used in an electronically scanning antenna.

The radiating part of such an antenna requires a large number of repetitive elements called modules, each formed from an elementary source and an associated phase shifter constituting a phase-shifting network.

In an earlier construction, such an elementary source is formed by a dipole supported by a metal plate inserted into the nipped end of a waveguide by which it is excited. This construction has the drawback of being cumbersome on account of the size of the waveguide and the arrangement of the dipole on a metal plate. Another drawback comes from the need for machining and mounting operations resulting in difficulties for industrial production, in uncertain reproducibility and in a relatively high cost.

OBJECT AND SUMMARY OF THE INVENTION

With the object of remedying these drawbacks, our invention provides a radiating source formed by a dipole excited by an extra-flat waveguide.

Such a construction satisfies the requirement for easy reproducibility of the radiating part of an electronic-sweep antenna.

According to one feature of the invention, the waveguide exciting the dipole is formed from a dielectric sheet having the form of a rectangular prism with a longitudinal axis or centerline whose two pairs of faces paralleling the axis are each covered by a metal layer of shorter length. The two major faces parallel to that axis are each extended towards the end of the dielectric sheet by a metal tongue terminating in the stems of the dipole.

We may, however, replace the dielectric sheet by a body of air in which case the waveguide will be simply a prismatic metal shell of rectangular cross-section.

One of the advantages of the radiator structure according to our invention is the compactness of the assembly dipole and the wave guide whose size is not increased by the addition of a phase shifter which is associated therewith to form a module usable in an electronically scanning antenna. Another advantage is the reduction in the cost of equipment and technology.

The above and other objects, features and advantages of the present invention will become apparent from the following description given solely by way of a nonlimiting illustration in conjunction with the accompanying drawing.

SPECIFIC DESCRIPTION

Figure 1:
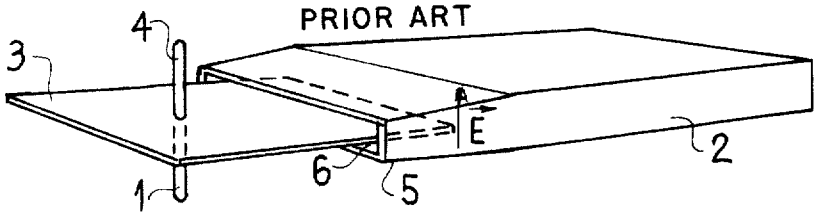
FIG 1 PRIOR ART
FIG. 1 shows a radiating source formed by a dipole excited by a waveguide according to a conventional construction.

Elements having the same reference characters in the several drawing Figures perform the same functions and are only described once.

It is much simpler to feed a dipole by means of a rectangular waveguide than by means of a coaxial line, the electric field produced in a coaxial line being radial in contrast to that produced in a rectangular guide.

FIG. 1 shows a conventional radiating source formed by a dipole 1 excited by a waveguide 2. The dipole is mounted on a metal plate 3 which fits into the opening 6 of guide 2 along the longitudinal midplane thereof. The stems 4 of the dipole are parallel to the direction of polarization of the electric field $\vec{E}$ propagated in guide 2 in mode $TE_{01}$, for example. Since the metal plate 3 is inserted along the longitudinal plane of symmetry of guide 2, the two stems 4 of dipole 1 are excited in the same manner. The impedance matching between dipole 1 and waveguide 2 is achieved by nipping the end 5 of the guide and by adjusting the extent to which dipole 1 is inserted into the opening 6 of the guide.

Figure 2:
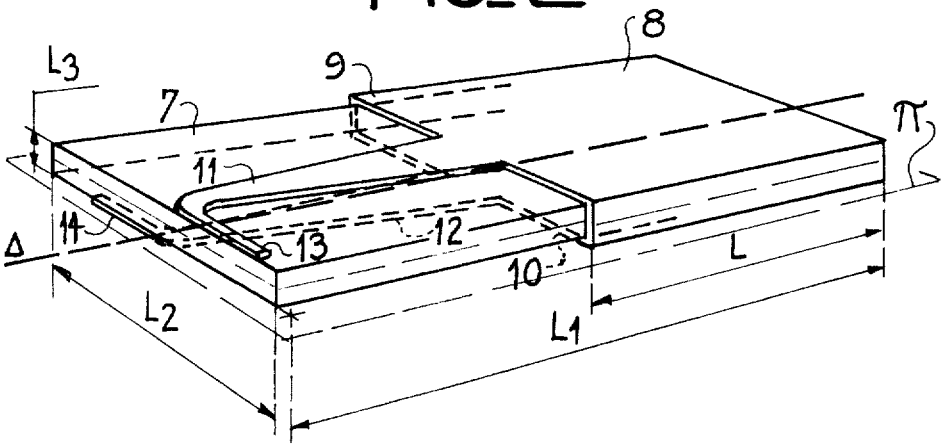
FIG. 2 shows an embodiment of a dipole excited by a waveguide in accordance with the invention.

FIG. 2 shows a radiating source in accordance with the invention. It comprises a dielectric sheet 7 in the form of a rectangular prism of length $L_1$, width $L_2$ and height $L_3$, having a longitudinal midplane $\pi$ and a longitudinal median axis or centerline $\Delta$.

The waveguide 8 is formed by a portion of sheet 7 of lesser length ($L<L_1$) whose opposite major faces parallel to plane $\pi$ and opposite minor faces perpendicular thereto and parallel to axis $\Delta$ are each covered with a metal plate of length L. The two metal plates 9 and 10 parallel to plane $\pi$, which form the major sides of a prismatic shell also including a pair of minor-side metal plates perpendicular thereto, are each extended by a respective metal tongue 11 and 12 terminating in stems 13 and 14 of the dipole. The width of tongues 11 and 12 decreases from waveguide 8 towards stems 13 and 14 for providing proper impedance matching between the guide and the dipole. In this Figure, stems 13 and 14 of the dipole are positioned flat against the end of dielectric sheet 7 and perpendicular to the direction of polarization of electric field $\vec{E}$ (cf. FIG. 1) in guide 8. These stems 13 and 14 are each formed by a metal strip perpendicular to the matching tongues 11, 12 and integral with the ends thereof. The width of these metal strips is chosen with due regard to the need for impedance matching between the dipole and the waveguide. The fact that the direction of stems 13 and 14 is perpendicular to the direction of polarization of the electric wave emitted by guide 8 causes the appearance of a crossed polarization wave. In some antennae, the residue of crossed polarization may serve for improving detection. Waveguide 8, tapering tongues 11 and dipole 12 and stems 13 and 14 may be layers formed by metallization (e.g. cadmium plating) or photo-etching.

Figure 3:
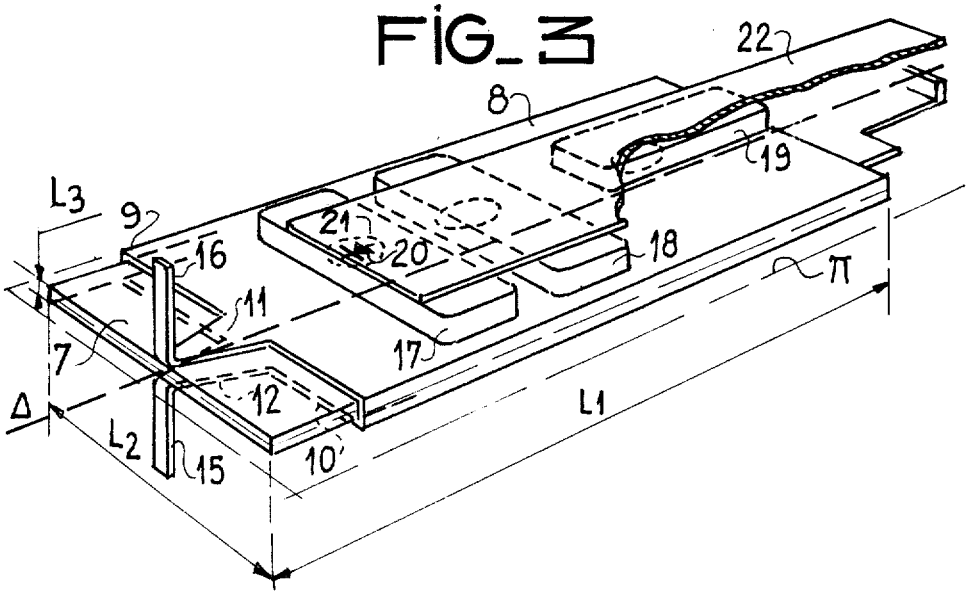
FIGS. 3 to 6 show four other embodiments of a dipole excited by a waveguide in accordance with the invention.

FIG. 3 shows another primary radiating source embodying our invention. Here, stems 15 and 16 of the dipole are parallel to the direction of polarization of the electric field $\vec{E}$ radiated by the waveguide. As before, guide 8 and tongues 11 and 12 may be formed by metal plating or by photo-etching, but the stems 15 and 16 are metal tongues ensuring a certain mechanical strength.

This radiating source may serve as an elementary radiator for an electronically scanning antenna. In this case the waveguide is connected to the output of one or more diodes forming part of the phase-shifting network of the antenna. In FIG. 3, phase shifters 17, 18 and 19 displacing the phase respectively by $3\lambda/4$, $\lambda/2$ and $\lambda/4$ are each formed by a diode 20 placed in a hole 21 provided in the full thickness L3 of dielectric sheet 7. This diode 20 is connected on one side directly to the metal plate covering one of the two major guide faces parallel to the longitudinal midplane and on the other side to a strip-line trap disposed on the opposite major face parallel to that plane so that the diode is grounded on both sides for ultrahigh frequency.

A printed circuit 22 is connected to the phase shifters 17–19 for feeding and controlling them. The height $L_3$ of dielectric sheet 7 is equal to the thickness of the diodes 20 of the phase shifters.

Figure 4:
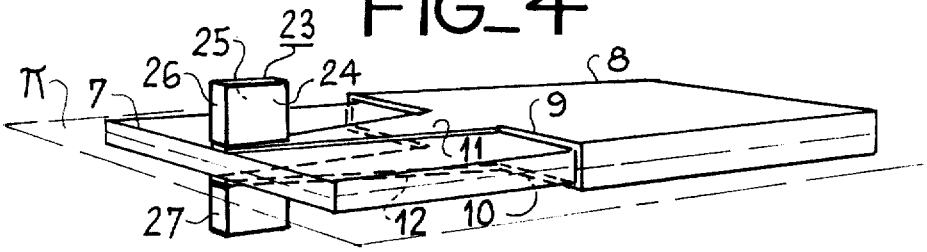

FIG. 4 shows another embodiment of a radiating source in accordance with the invention in which the stems of the dipole have a better mechanical strength than in the preceding Figure. There is disposed on the matching tongue 11 or 12 a small dielectric substrate plate 23 in the form of a rectangular prism and having the same width as the corresponding tongue 11 or 12, so that its large sides 24 and 25 are perpendicular to the longitudinal midplane $\pi$; the small side perpendicular to plane $\pi$ and situated at the end of dielectric sheet 7 is metallized to form the stems 26 and 27 of the dipole.

Figure 5:
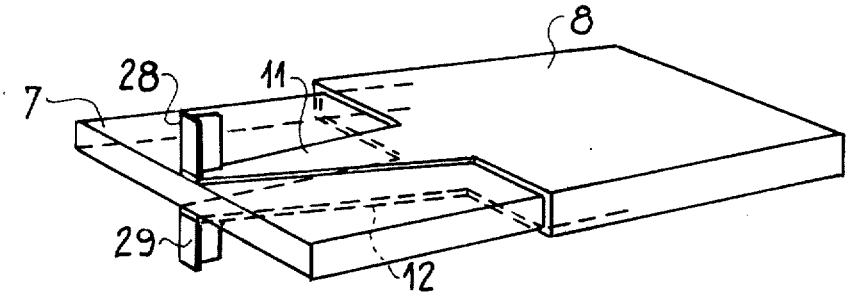
Figure 6:
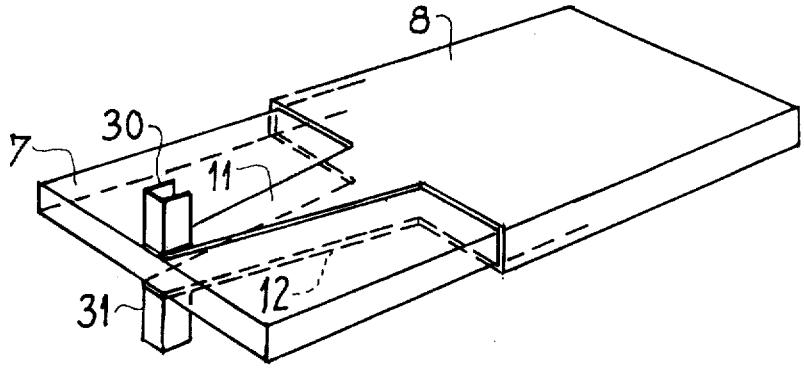

Another embodiment of the dipole stems is shown in FIG. 5 where stems 28 and 29 are formed by metal strip machined to a T profile; in FIG. 6 on the other hand, stems 30 and 31 are U-shaped.

Figure 7:
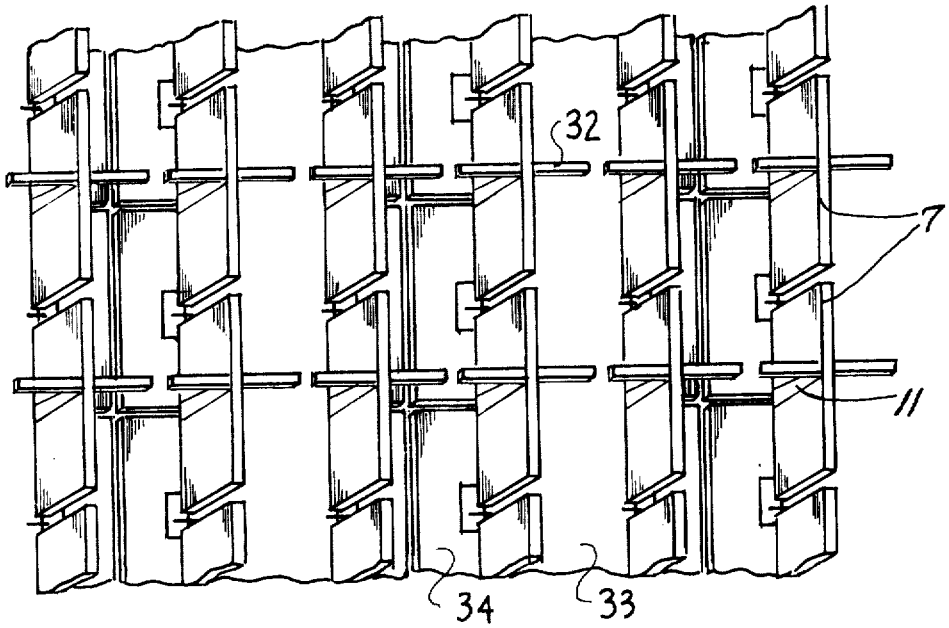
FIG. 7 shows an electronically scanning antenna comprising elementary radiating sources in accordance with the invention.

FIG. 7 shows an electronically scanning antenna whose elementary sources are constructed in accordance with the invention. All the dipoles 32 are oriented in the same direction which is that of the polarization of the antenna. At a distance equal to a quarter of the operating wavelength, i.e. $\lambda/4$, are placed reflecting members 33, 34, e.g. of aluminum forming the reflector of the antenna. For reasons of mechanical strength and ease of assembly, each row of radiators with longitudinal axes perpendicular to the direction of the stems of the dipoles is flanked on one side by a metal plate 33 whose length is equal to the height of the row and on the other side by metal plates 34 whose length is equal to the distance separating two dipoles. The antenna may have a variety of forms, e.g. flat or parabolic.

Thus we have described several possible embodiments of a radiating source formed by a dipole fed by means of an extra-flat waveguide, of very reduced dimensions in relation to those of the prior art. Since no very expensive equipment is required and since the technical difficulties are not too great, the overall cost of such a source is relatively low.

What is claimed is:

1. A radiating source formed by a dipole with two stems excited by a rectangular-section waveguide, comprising a dielectric sheet in the form of a rectangular prism of length $L_1$, width $L_2$ and height $L_3$ whose two opposite major faces parallel to a longitudinal midplane $\pi$ and two opposite minor faces perpendicular to said midplane and parallel to the longitudinal centerline $\Delta$ of the sheet are each covered with a metal layer of length L less than $L_1$ for forming said waveguide, the metal layers covering said major opposite faces being each extended along said centerline $\Delta$ by a metal tongue of reduced width terminating in a respective stem of said dipole.

2. A radiating source as defined in claim 1 wherein said metal tongue has a width decreasing from said waveguide towards the stems of the dipole, providing impedance matching therebetween.

3. A radiating source as defined in claim 1 wherein said two opposite major faces as well as said two opposite minor faces are metallized over a length L less than $L_1$, thus forming said layers.

4. A radiating source as defined in claim 1 wherein each of the stems of the dipole, whose direction is perpendicular to the electric field radiated by said waveguide, lies flat against the end of said dielectric sheet remote from said waveguide and is formed by a narrow metal strip perpendicular to said tongue and in contact with the end thereof.

5. A radiating source as defined in claim 1 wherein each stem of the dipole, whose direction is parallel to the plane of polarization of the wave radiated by said waveguide, is perpendicular to said tongue and in contact with the end thereof.

6. A radiating source as defined in claim 5 wherein each stem of the dipole comprises a narrow metal plate separate from said tongue.

7. A radiating source as defined in claim 5 wherein said stems of the dipole are formed by a narrow T-shaped metal profile.

8. A radiating source as defined in claim 5 wherein said stems of the dipole are formed by a narrow U-shaped metal profile.

9. A radiating source as defined in claim 5 wherein a small dielectric substrate in the form of a rectangular prism and of the same width as said tongue is disposed against the latter with wider sides perpendicular to the midplane $\pi$ and with a metallized narrower side perpendicular to midplane $\pi$ situated at the end of said tongue to form a stem of the dipole.

10. A radiating source as defined in claim 1, forming part of an electronically scanning antenna, said waveguide being connected directly to an output of at least one diode phase shifter.

11. A radiating source as defined in claim 10 wherein said phase shifter is formed by a diode placed in a hole traversing the entire thickness of said dielectric sheet, said diode being connected on one side to a strip-line trap on the metal layer covering one major face of said sheet and on the other side directly to the metal layer covering the opposite major face thereof.

12. A radiating source as defined in claim 11 wherein the height $L_3$ of said dielectric sheet is equal to the thickness of the diode forming said phase shifter.

13. A radiating source as defined in claim 12 wherein said phase shifter is fed and controlled by a printed circuit placed parallel to the dielectric sheet.

14. A radiating source as defined in claim 8 wherein reflecting members are situated perpendicularly to and on each side of said dielectric sheet, at a distance from said stems equal to a quarter of the operating wavelength.

15. A radiating source as defined in claim 14 wherein the metal layers covering said dielectric sheet are made from cadmium and said reflecting members are made from aluminum.

16. A radiating source comprising a dipole excited by a waveguide, said waveguide including a prismatic metal shell of rectangular cross-section with a pair of major plates and a pair of minor plates paralleling a longitudinal centerline, and a dielectric sheet occupying the interior of said shell and projecting therefrom along said centerline, said major plates being provided with respective integral tongues of lesser width carried on major surfaces of said sheet, said tongues extending longitudinally on said sheet beyond said minor sides and terminating in respective oppositely extending stems constituting said dipole.

17. A radiating source as defined in claim 16 wherein said tongues taper from said shell to said dipole.

* * * * *